US010273136B1

(12) United States Patent
Briley

(10) Patent No.: US 10,273,136 B1
(45) Date of Patent: Apr. 30, 2019

(54) BEVERAGE DISTRIBUTOR FOR PARTY GAMES

(71) Applicant: William Briley, Chicago, IL (US)

(72) Inventor: William Briley, Chicago, IL (US)

( * ) Notice: Subject to any disclaimer, the term of this patent is extended or adjusted under 35 U.S.C. 154(b) by 0 days.

(21) Appl. No.: 15/851,402

(22) Filed: Dec. 21, 2017

(51) Int. Cl.

| | |
|---|---|
| ***B67D 3/00*** | (2006.01) |
| ***B65D 47/20*** | (2006.01) |
| ***B65D 47/06*** | (2006.01) |
| *A63F 7/30* | (2006.01) |
| *A63B 67/06* | (2006.01) |

(52) U.S. Cl.
CPC ..... *B67D 3/0058* (2013.01); *B65D 47/06* (2013.01); *B65D 47/20* (2013.01); *A63B 67/06* (2013.01); *A63F 7/30* (2013.01); *A63F 2250/024* (2013.01); *A63F 2250/04* (2013.01)

(58) Field of Classification Search
CPC ..... B67D 3/0085; B65D 47/06; B65D 47/20; A63B 67/06; A63F 2250/024; A63F 2250/04
USPC ..... 222/565, 478, 482–485, 380, 222/181.1–181.3, 185.1; 141/237, 242, 141/243; 417/440, 397
See application file for complete search history.

(56) References Cited

U.S. PATENT DOCUMENTS

| | | | | | |
|---|---|---|---|---|---|
| 250,500 | A * | 12/1881 | Chewning | 141/237 | |
| 553,734 | A * | 1/1896 | Iredale | 141/237 | |
| 858,051 | A * | 6/1907 | Allen | 141/237 | |
| 1,202,439 | A * | 10/1916 | Scott | B65D 47/265 | 141/242 |
| 5,168,905 | A * | 12/1992 | Phallen | B65B 3/36 | 141/1 |
| 5,381,839 | A * | 1/1995 | Dowd | B65B 3/30 | 141/237 |
| 6,834,687 | B2 * | 12/2004 | Abzaletdinov | F16N 31/004 | 141/237 |
| 6,968,867 | B2 * | 11/2005 | Jenkins | B65B 39/00 | 141/129 |
| D543,666 | S * | 5/2007 | Ross | D30/133 | |

* cited by examiner

*Primary Examiner* — Lien Ngo
(74) *Attorney, Agent, or Firm* — Foley & Lardner LLP

(57) ABSTRACT

A beverage distributor includes a reservoir having a reservoir first end and a reservoir second end. The reservoir first end and reservoir second end are open. A valve is connected to the reservoir second end. The valve throttles a flow of fluid from the reservoir. A plurality of passage tubes are connected to the valve. Each of the plurality of passage tubes has an inlet and an outlet. Each inlet of the plurality of passage tubes receives a flow of fluid from the reservoir through the valve. The plurality of passage tubes includes a first passage tube that includes a first diameter and length, a second passage tube that includes a second diameter and length, and a third passage tube that includes a third diameter and length. A base is connected to at least one of the first passage tube, the second passage tube, and the third passage tube.

17 Claims, 9 Drawing Sheets

BEVERAGE DISTRIBUTOR FOR PARTY GAMES

BACKGROUND

The present disclosure relates generally to the field of beverage distributors for party games. Generally, partygoers play party games by splitting into teams, manually arranging plastic cups into a geometric pattern and filling those cups with a beverage. In one such game, two teams take turns throwing balls into the other team's cups. When they successfully sink a ball into a cup, the other team consumes the beverage in the cup. In other games, each team attempts to consume the beverage in their cups and then flip the cups over once the beverages have been consumed. In both games, a great deal of importance is placed on the arrangement of the cups and on the amount of beverage in the cups; therefore, it can be problematic when the placement and filling of the cups becomes more erratic as the party continues.

SUMMARY

Various embodiments relate to a beverage distributor for party game systems and methods. A beverage distributor includes a reservoir having a reservoir first end and a reservoir second end. The reservoir first end and reservoir second end are open. A valve is connected to the reservoir second end. The valve throttles a flow of fluid from the reservoir. A plurality of passage tubes are connected to the valve. Each of the plurality of passage tubes has an inlet and an outlet. Each inlet of the plurality of passage tubes receives a flow of fluid from the reservoir through the valve. The plurality of passage tubes includes a first passage tube that includes a first diameter and length , a second passage tube that includes a second diameter and length, and a third passage tube that includes a third diameter and length. The first diameter is structured to cause a first flow rate of the flow of fluid through the first passage tube. The second diameter is structured to cause a second flow rate of the flow of fluid through the second passage tube. The third diameter is structured to cause a third flow rate of the flow of fluid through the third passage tube. The third length is less than the second length and the first length. A base is connected to at least one of the first passage tube, the second passage tube, and the third passage tube. At least one of the first passage tube, the second passage tube, and the third passage tube passes through the base.

Various other embodiments relate to a method comprising placing a plurality of cups in a desired formation, orientating a beverage distributor for party games above the plurality of cups. The beverage distributor includes a reservoir having a reservoir first end and a reservoir second end. The reservoir first end and reservoir second end are open. A valve is connected to the reservoir second end. The valve throttles a flow of fluid from the reservoir. A plurality of passage tubes are connected to the valve. Each of the plurality of passage tubes has an inlet and an outlet. Each inlet of the plurality of passage tubes receives a flow of fluid from the reservoir through the valve. The plurality of passage tubes includes a first passage tube that includes a first diameter and length, a second passage tube that includes a second diameter and length, and a third passage tube that includes a third diameter and length. The first diameter is structured to cause a first flow rate of the flow of fluid through the first passage tube. The second diameter is structured to cause a second flow rate of the flow of fluid through the second passage tube. The third diameter is structured to cause a third flow rate of the flow of fluid through the third passage tube. The third length is less than the second length and the first length. A base is connected to at least one of the first passage tube, the second passage tube, and the third passage tube. At least one of the first passage tube, the second passage tube, and the third passage tube passes through the base. The base is aligned with the desired formation of the plurality of cups. The valve attached to the base of the beverage distributor is closed. A fluid is poured into the reservoir attached to the valve of the beverage distributor. The valve is opened, causing the fluid to travel through the plurality of passage tubes and into the plurality of cups.

Various other embodiments relate to an apparatus that includes a reservoir having a reservoir first end and a reservoir second end. The reservoir first end and the reservoir second end are open. A plurality of passage tubes are connected to the reservoir. Each of the plurality of passage tubes has an inlet and an outlet. Each inlet of the plurality of passage tubes receives a flow of fluid from the reservoir through the reservoir. The plurality of passage tubes includes a first passage tube that includes a first diameter and length, a second passage tube that includes a second diameter and length, and a third passage tube that includes a third diameter and length. The first diameter is structured to cause a first flow rate of the flow of fluid through the first passage tube. The second diameter is structured to cause a second flow rate of the flow of fluid through the second passage tube. The third diameter is structured to cause a third flow rate of the flow of fluid through the third passage tube. The third length is less than the second length and the first length. A base is connected to at least one of the first passage tube, the second passage tube, and the third passage tube. At least one of the first passage tube, the second passage tube, and the third passage tube passes around the base.

Various other embodiments relate to the length, diameter, and placement of the passage tubes as to ensure an even flow of fluid from the reservoir. Further embodiments relate to the material of the passage tubes as to improve the flow of the fluid. Further embodiments relate to the frequency of measurement marks on the reservoir to encourage a variety of fluids and volumes of fluids. Further embodiments relate to the rigidity of the passage tubes as to provide support for the reservoir. Further embodiments relate to the material of the reservoir and base as to ensure durability of the device. Further embodiments relate to the vertical extensions from the base as to align the cups placed underneath the device.

BRIEF DESCRIPTION OF THE DRAWINGS

The foregoing and other features of the present disclosure will become more fully apparent from the following description and appended claims, taken in conjunction with the accompanying drawings. Understanding that these drawings depict only several implementations in accordance with the disclosure and are, therefore, not to be considered limiting of its scope, the disclosure will be described with additional specificity and detail through use of the accompanying diagrams.

Figure 1:
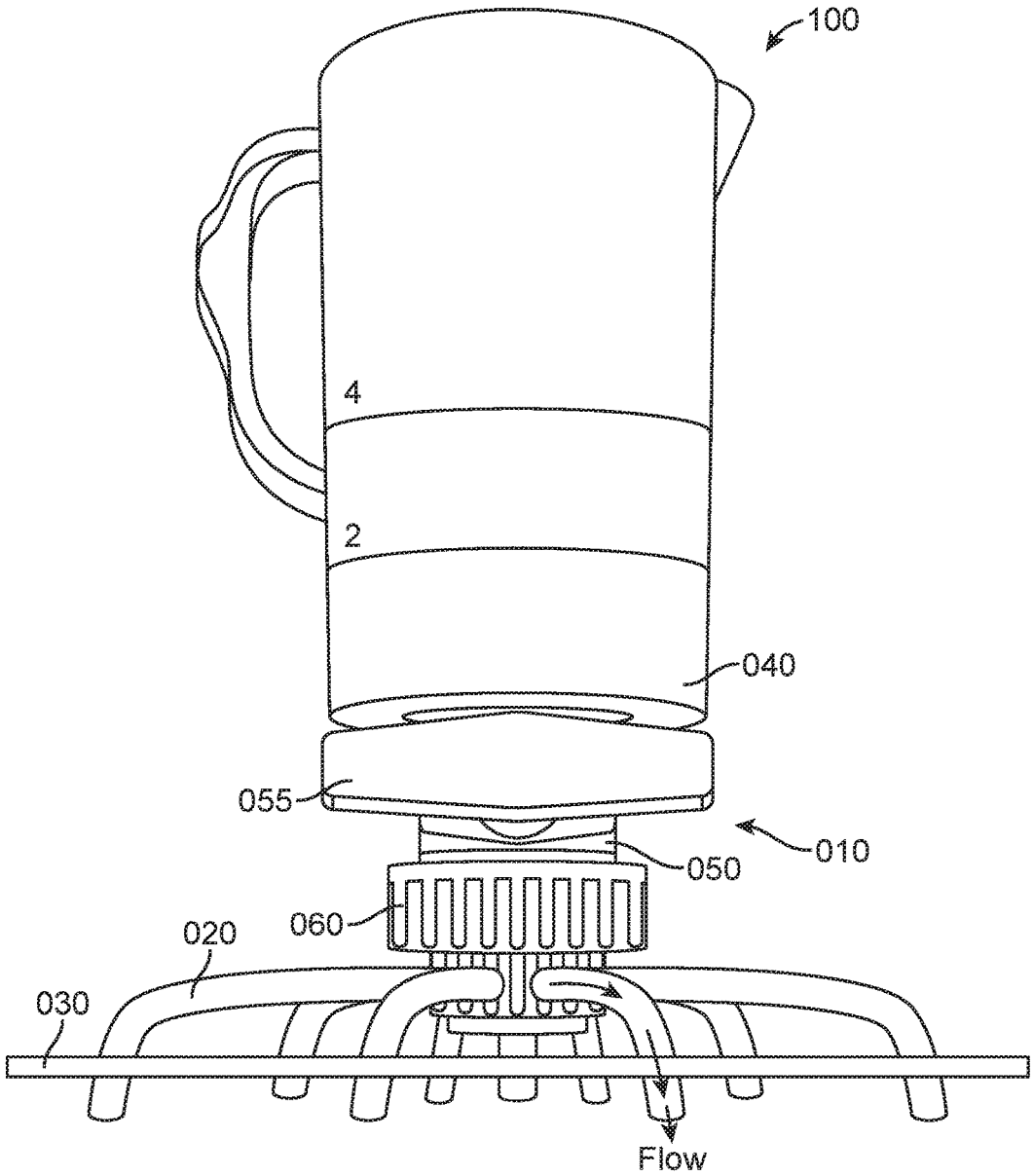
FIG. 1 is a side view of a beverage distributor for party games, according to an example embodiment.

Reference is made to the accompanying drawings throughout the following detailed description. In the drawings, similar symbols typically identify similar components, unless context dictates otherwise. The illustrative implementations described in the detailed description, drawing, and claims are not meant to be limiting. Other implementations may be utilized, and other changes may be made, without departing from the spirit or scope of the subject matter presented here. It will be readily understood that the aspects of the present disclosure, as generally described herein and illustrated in the figures, can be arranged, substituted, combined, and designed in a wide variety of different configurations, all of which are explicitly contemplated and made part of this disclosure.

DETAILED DESCRIPTION

The present disclosure relates to a beverage distributor for party games used to expedite the setup of party games and ensure that the rules of the games are followed.

With beverage-based party games, a great deal of importance is placed on the arrangement of the cups and amount of beverage in the cups. Consequently, it can be problematic when the placement and filling of the cups becomes more erratic as the party continues. Accordingly, there is a need for a party game device for expediting the setup of party games and ensuring that the rules of the game are followed by distributing equal amounts of a beverage to each cup and aligning the cups properly, especially as parties go on into late nights. Therefore, it is desirable to have a device that ensures both a proper alignment of cups and an equal distribution of the chosen beverage for the party game. Further, it is important that such a device be durable and sturdy because it will often be handled recklessly by partygoers. It is also beneficial that the various parts of such a device be separable and individually washable to facilitate sanitation. It is also important that the distributer be comprised of rounded edges to encourage physical safety in a party environment. The beverage distributor for party games meets these requirements by providing a device that allows for expedited set up and beverage distribution in a way that alleviates user error. Generally, the beverage distributor for party games comprises a reservoir with an open bottom, a valve to control the flow of a fluid, a plurality of passage tubes to transfer the fluid from the reservoir to a plurality of cups, and a base to support the device and align the plurality of cups. The beverage distributor for party games is able to be disassembled in order to allow for easier cleaning. As will be appreciated, the portions of the beverage distributor coming into contact with the beverage are food-safe.

FIG. 1 is a perspective few of a beverage distributor for party games 100, according to an example embodiment. As illustrated in FIG. 1, the beverage distributor for party games 100 includes a reservoir 040, a valve 010, and a base 030. To facilitate cleaning, the various parts of the beverage distributor for party games 100 may be removably coupled so that the device may be disassembled. In other embodiments, the beverage distributor for party games 100 may be disassembled further into more components than just the reservoir 040, valve 010, and base 030. For example, one or all of the tubes in a plurality of tubes 020 attached to the valve 010 may be removable.

The reservoir 040 has a first end and a second end. The first end serves as an intake opening to receive a fluid, such as a beverage. The intake opening (e.g., inlet) can be structured to be wide enough to mitigate user error. The second end serves as an outlet opening and facilitates the fluid leaving the reservoir 040 through the outlet opening. The outlet opening is connected to the valve 010. In some embodiments, reservoir 040 includes measurements marked on the outside of the reservoir 040. In some embodiments, the measurements are written on the side of the reservoir 040, while in other embodiments the measurements are etched or molded into the reservoir 040.

The valve 010 includes a flow restrictor 050 and a passage tube junction 060. The valve 010 is connected to the outlet end of the reservoir 040 (e.g., downstream the reservoir 040) and is above (e.g., upstream) the base 030. The valve 010 facilitates the holding and release of the fluid from the reservoir 040 into a plurality of cups 036. The flow restrictor 050 is disposed between the outlet end of the reservoir 040 and the passage tube junction 060. In other words, the flow restrictor 050 is downstream from the reservoir 040 and upstream of the passage tube junction 060. Generally, the flow restrictor 050 works to control the passage of fluid through the beverage distributor for party games 100. For example, the flow restrictor 050 includes an open position that allows the flow of fluid therethrough and a closed position that prevents the flow of fluid therethrough. Beneficially, the flow restrictor 050 may be used to pour a beverage into the reservoir 040 and control the flow through the system to the plurality of cups 036 below the plurality of passage tubes 020 by alternating between the open and closed position. The flow restrictor 050 is described in greater detail below in FIG. 4.

The passage tube junction 060 is coupled to the flow restrictor 050. The passage tube junction 060 is upstream of the plurality of passage tubes 020 and downstream the flow restrictor 050. In some arrangements, the passage tube junction 060 and flow restrictor 050 are formed as a single piece. In other arrangements, the passage tube junction 060 and flow restrictor 050 are removably coupled by, for example, a threaded connection. The passage tube junction 060 generally functions as a gathering hub for the fluid to drain through a plurality of inlets of the plurality of passage tubes 020. In one embodiment, the outtake opening of the reservoir 040 may be removably coupled to the flow restrictor 050. The flow restrictor 050 may then be removably coupled to the passage tube junction 060, into which the plurality of inlets of the plurality of passage tubes 020 lead. This ability to removably couple the individual parts may be enabled in some arrangements by a threaded interface, in some arrangements by a ribbed interface, and in other arrangements by a slotted interface. The plurality of outlets of the plurality of passage tubes 020 may be connected to and/or pass through the base 030.

The plurality of passage tubes 020 are connected to the passage tube junction 060. As shown in FIG. 1, all but one of the plurality of passage tubes 020 extend radially from an external surface of the passage tube junction 060 with one passage tube in the plurality of passage tubes 020 extending axially downward from the passage tube junction 060. In other arrangements, one or more of the plurality of passage tubes 020 may extend radially downward from the passage tube junction 060.

The plurality of passage tubes 020 enable the flow of fluid through the beverage distributor for party games 100. Each passage tube in the plurality of passage tubes 020 has an inlet and an outlet. Fluid enters each passage tube through the inlet and exits each passage tube through the outlet. The plurality of inlets of the plurality of passage tubes 020 are connected to and open into the passage tube junction 060. The passage tubes pass through, or in some arrangements around, the base 030 to be disposed in locations to the desired pattern. In other words, the plurality of outlets of the plurality of passage tubes 020 are located where the plurality of cups 036 will be placed to receive the beverage. In some embodiments, the plurality of outlets may extend a target distance past the base 030, but in other embodiments, the plurality of outlets may be flush with the base 030. Further, in some embodiments, the plurality of passage tubes 020 may pass around the base 030 rather than through the base 030. The plurality of passage tubes 020 are described in greater detail below in FIG. 7.

Expanding upon the flow of fluid through the plurality of passage tubes 020, the flow in each tube may be approximated in many ways, including the Darcy Weisbach equation as applied to the shape of each tube in the plurality of passage tubes 020. As will be appreciated, the Darcy Weisbach equation, reproduced below, provides the instantaneous flow between two points, but since AP changes over time as the beverage drains, integrating the equation would provide the flow of the beverage over time. The equation is:

$$Q = \sqrt{\frac{2(\Delta P)D}{\rho L f}}\,A$$

The instantaneous flow (Q) through any two chosen points is dependent on the difference in pressure being measured (AP), the hydrodynamic diameter of the tube (D), the density of the liquid (p), the length between two points of measurement (L), the friction factor (f), and the cross-sectional area of the portion of the tube being measured (A). The hydrodynamic diameter of the tube is not the same as the diameter, rather it is a general measurement that can be calculated for any shape of tube. The friction factor takes into account any and all resistances to the flow. These resistances include bends in the tube, aberrant flow around the tube inlets, the direction of the tubes, resistance in the flow restrictor or any other couplings, etc. This could be different for each tube and will change if the flow is laminar or turbulent. Any of these factors may be modified for one or more tube in the plurality of passage tubes 020 in order to achieve a specified flow rate or total fluid output.

The base 030 generally serves as support for the beverage distributor for party games 100 and ensures that the plurality of passage tubes 020 are in the proper arrangement for party games. The base 030 is connected to the valve 010 by way of at least one of the plurality of passage tubes 020 or a similar support structure. In some embodiments, the base 030 may receive the plurality of outlets of the plurality of passage tubes 020 and hold the plurality of outlets in a fixed position. Further, in other embodiments, the plurality of outlets may extend a target distance past the base 030, but in other embodiments, the plurality of outlets may be flush with the base 030.

In other embodiments, the plurality of passage tubes 020 may pass outside of the base 030 (e.g., structured to go around the base 030).

The beverage distributor for party games 100 also encourages proper alignment of a plurality of cups 036 (see FIG. 8 below). In some embodiments, due to the clear nature of the base 030, it is possible for users to visually align the plurality of cups 036 with the fixed positions of the plurality of outlets. Further, in some embodiments, the base 030 may be shaped to the target dimensions of the desired arrangement of the plurality of cups 036, which may provide another guide for proper alignment.

In another embodiment, proper alignment of the plurality of cups 036 is encouraged by vertical extensions 035 that protrude from the base 030 away from the reservoir. These vertical extensions are described in greater detail below in FIG. 8.

As stated earlier, a problem of party games is that users may treat any device to assist in the setup of such party games in a reckless manner. Therefore, the beverage distributor for party games 100 is structured to be durable and safe. Accordingly, the base 030 and reservoir 040 are constructed from a durable material, such as but not limited to a heavy duty plastic. Further, the plurality of passage tubes 020 are constructed from a similarly durable material, although the plurality of passage tubes 020 may be rigid in some embodiments and non-rigid in other embodiments. Likewise, the base 030 is made to be absent of sharp edges or corners to promote safety in the case of reckless use.

Figure 2:
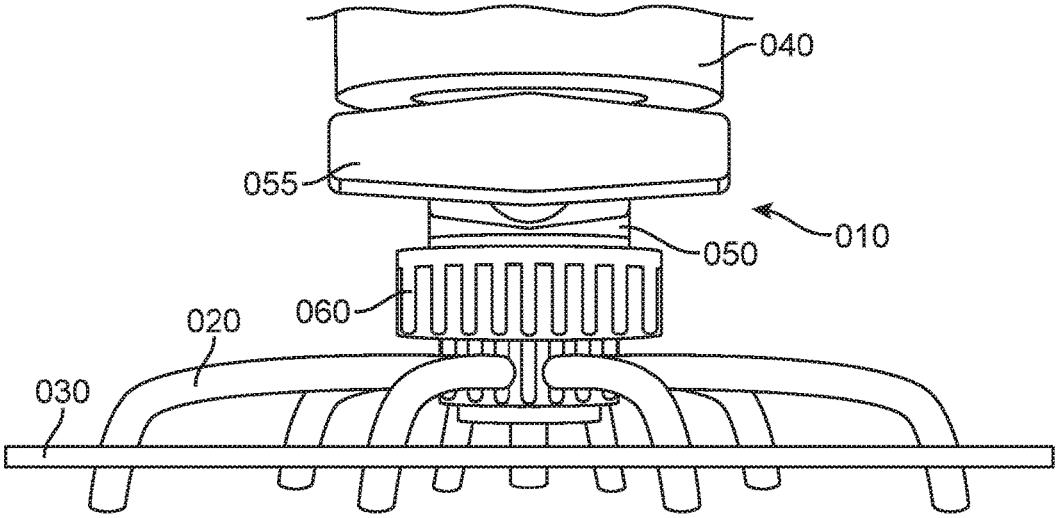
FIG. 2 is a side view of a valve, a plurality of passage tubes, and a base of the beverage distributor for party games shown in FIG. 1.

FIG. 2 is a side view of the valve and the base. Generally the valve 010 is in place to control a flow of fluid from the reservoir 040 into the plurality of passage tubes 020. When the valve 010 is in the closed position, the fluid remains in the reservoir 040. When the valve 010 is in the open position, the fluid flows from the reservoir 040 into the plurality of passage tubes 020.

Figure 3:
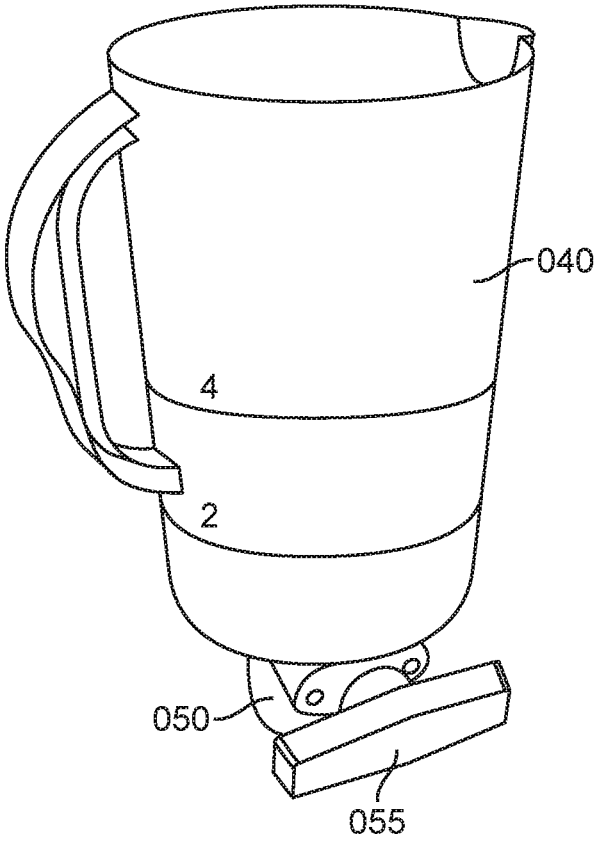
FIG. 3 is a perspective view of a reservoir and the flow restrictor of the beverage distributor for party games shown in FIG. 1.

FIG. 3 is a perspective view of the reservoir 040 and the flow restrictor 050. FIG. 3 shows an example embodiment where the flow restrictor 050 is removably de-coupled from the passage tube junction 060. In such an embodiment, the removability of the reservoir 040 and flow restrictor 050 from the rest of the beverage distributor for party games 100 allows for the reservoir 040 to be filled in a separate location from the rest of the device so that users do not need to carry the entire device through a crowded party each time the beverage needs to be refilled from a central source.

Figure 4:
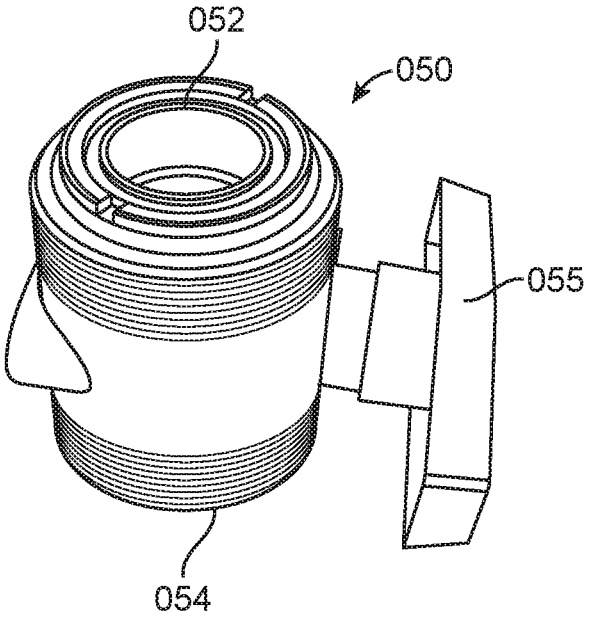
FIG. 4 is a perspective view of a flow restrictor of the beverage distributor for party games shown in FIG. 1.

FIG. 4 is a perspective view of the flow restrictor 050. The flow restrictor 050 has two ends. In some embodiments, the first end is an intake opening that may be connected to the reservoir 040. In some embodiments, the second end is an outtake opening that may be connected to the passage tube junction 060. The fluid enters the flow restrictor 050 through the intake opening. The flow restrictor 050 has an adjustable aperture that has both an open position and a closed position. In some embodiments, the adjustable aperture may have a plurality of positions between the open position and closed position that throttle the flow of fluid through the flow restrictor 050. Further, in some embodiments, the adjustable aperture may be manually adjustable by an exterior knob or switch. FIG. 4 provides an example embodiment of an exterior knob 055 being utilized to adjust the aperture. After the fluid enters the flow restrictor 050 through the intake opening, the fluid reaches the adjustable aperture. If the adjustable aperture is in the completely open position, the fluid flows through unimpeded. Conversely, if the adjustable aperture is in the completely closed position, the fluid remains stationary. If the adjustable aperture is in any position between completely open and completely closed, as is possible in some embodiments, the fluid is able to flow through but at a slower rate. Once the fluid passes through the adjustable aperture, the fluid exits the flow restrictor 050 through an outtake opening 045.

Figure 5:
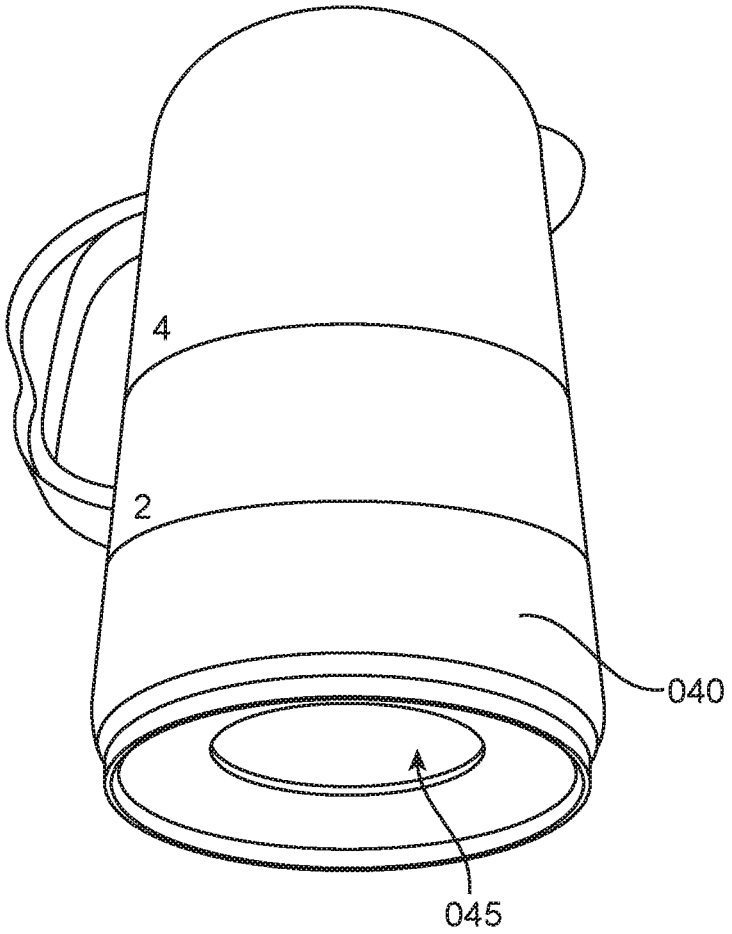
FIG. 5 is a bottom perspective view of the reservoir of the beverage distributor for party games shown in FIG. 1.

FIG. 5 is a perspective view of the bottom of the reservoir 040. FIG. 5 provides an example embodiment in which the reservoir 040 is removably coupled from the rest of the device. Such removability allows the reservoir 040 to be thoroughly cleaned in order to encourage sanitary conditions. The example embodiment in FIG. 5 also shows the outtake opening 045 to which the flow restrictor 050 is connected, as seen in FIG. 3.

FIG. 5 also shows an example embodiment in which measurements are written on the side of the reservoir 040. Generally, such measurements allow for uniform pours of a beverage, even when the beverage is being poured from a common source, such as a keg or water cooler, rather than from individually portioned containers. Further, such measurements can facilitate use of the beverage distributor for party games 100 by allowing users to quickly determine how much of the beverage is in the reservoir 040 without requiring any calculations or other measurement devices.

Figure 6:
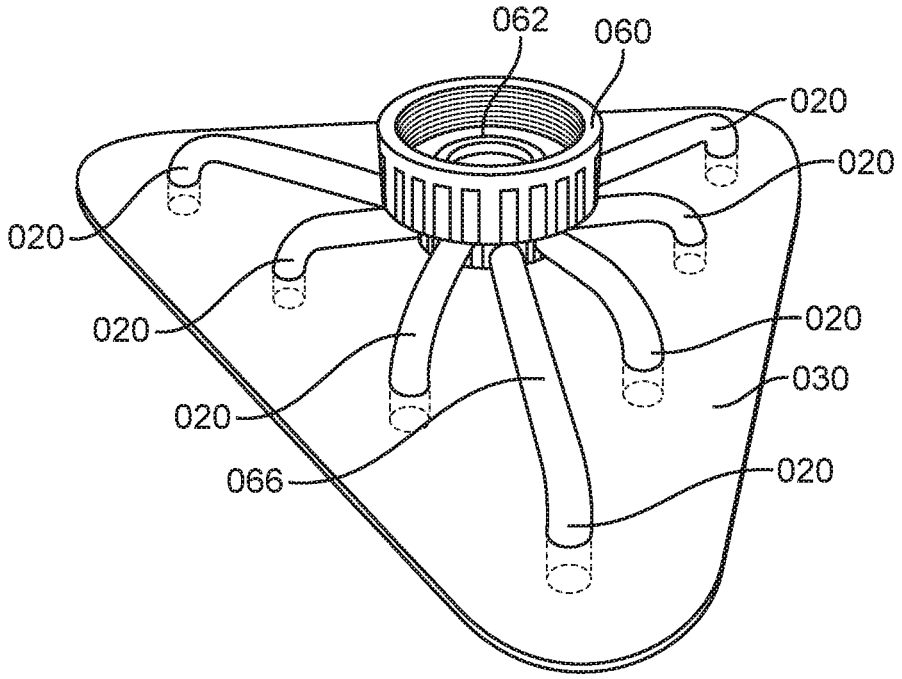
FIG. 6 is a perspective view of the plurality of passage tubes, a passage tube junction, and the base of the beverage distributor for party games shown in FIG. 1.

FIG. 6 is a perspective view of the passage tube junction 060, the plurality of passage tubes 020, and the base 030. FIG. 6 provides an example embodiment in which the passage tube junction 060 is removably de-coupled from the flow restrictor 050. In other embodiments, the passage tube junction 060 might further be removably coupled to the plurality of passage tubes 020.

FIG. 6 shows that the passage tube junction 060 has a first end 062 that couples to a portion of the beverage distributor for party games 100, such as, the flow restrictor 050. The fluid enters the passage tube junction 060 through the first end 062 that is in fluid communication with the reservoir 040 and exits the passage tube junction 060 through the plurality of inlets of the plurality of passage tubes 020 disposed around the passage tube junction 060. In some embodiments, one or more of the plurality of passage tubes 020 may include a flow restrictor at, for example, location 060. The placement of a flow restrictor on an individual passage tube allows for the beverage distributor for party games 100 to be used with a variety of formations and a varying number of cups 036. For example, FIGS. 1-9 show ten passage tubes in the plurality of passage tubes 020; thus, when the flow restrictor 055 on the valve 050 is open, the fluid is able to flow through all ten passage tubes. The addition of a flow restrictor on one, multiple, or all passage tubes allows the user of the beverage distributor for party games 100 to allow fluid to flow through one, some, or all ten passage tubes in the plurality of passage tubes 020. This is beneficial for deviations from the traditional ten cup set up to a game with, for example, six or three cup set ups.

Figure 7:
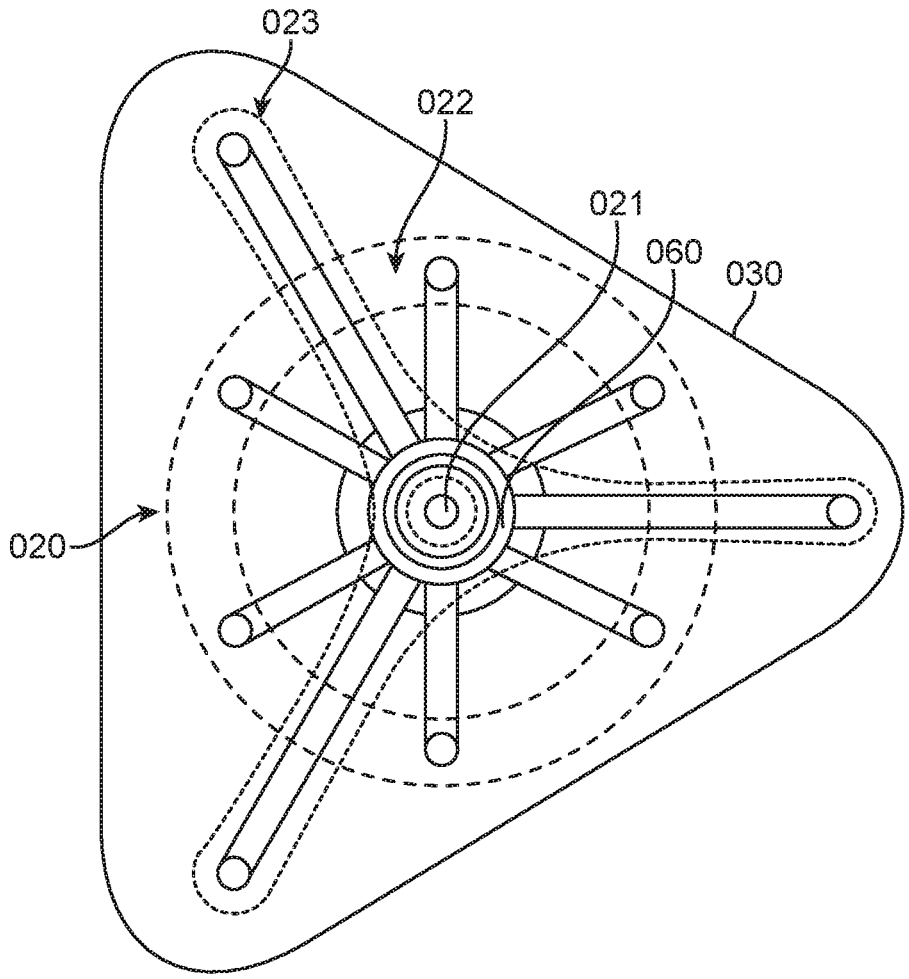
FIG. 7 is a bottom view of the plurality of tubes, the tube junction, and the base of FIG. 6.

FIG. 7 is a bottom view of the passage tube junction 060, the plurality of passage tubes 020, and the base 030, the same collection of parts as from FIG. 6. FIG. 7 shows an example arrangement of the plurality of passage tubes 020 in which the plurality is split into three groups: an inner group of one passage tube 021, a middle group of six passage tubes 022, and an outer group of three passage tubes 023. In this example embodiment, the outer group of passage tubes 023 are the longest and have the largest diameter. Further, the inner group of a single passage tube 021 is the shortest and has the smallest diameter. The middle group of passage tubes 022 has a length and diameter in between those of the outer group of passage tubes 023 and the inner group of a passage tube 021. As will be appreciated, the varying diameters and lengths allow for a substantially similar flow path through each tube in the group of passage tubes (021, 022, 023). As will also be appreciated, alterative configurations, arrangements, groupings, and orientations of the plurality of passage tubes 020 are possible to provide a wide variety of shapes, appearances, user-experiences, and number of fillable cups. While the plurality of passage tubes 020 is shown as having three groups that are concentrically arranged, various other configurations and orientations are possible.

According to various embodiments, the beverage distributor for party games 100 ensures equal distribution of a beverage using a plurality of passage tubes 020 and a valve 010. In some embodiments, equal distribution may be ensured by having the plurality of passage tubes 020 be of equal length and equal diameter. Further, in those embodiments, the plurality of inlets of the plurality of passage tubes 020 may all enter the passage tube junction 060 at the same height relative to a horizontal playing surface. In other embodiments, such as the example embodiment provided in FIG. 7, equal distribution may be ensured by having the plurality of passage tubes 020 be of differing length and differing diameter, where the length and diameter of each passage tube may be determined by the Darcy Weisbach equation, as outlined above, or modified in accordance with changes to the flow structure(s) of the beverage distributor for party games 100. Further, in those embodiments, the plurality of inlets of the plurality of passage tubes 020 may enter the passage tube junction 060 at differing heights relative to the horizontal playing surface, where those differing heights may be determined by the Darcy Weisbach equation, as outlined above, or modified in accordance with changes to the flow structure(s) of the beverage distributor for party games 100.

In some embodiments, the plurality of passage tubes 020 may be rigid and inflexible, which would allow them to support the weight of the reservoir 040 and valve 010. In other embodiments, the plurality of passage tubes 020 may be flexible, which would allow them to be easily arranged in various shapes and patterns. In some embodiments, the plurality of passage tubes 020 may include a portion of each tube being rigid and a different portion of each tube being flexible. For example, a portion adjacent the inlet of the passage tube (e.g., near the passage tube junction 060) and outlet of the passage tube (e.g., adjacent the base 030) are rigid to provide support to the overall structure with the remaining passage tube length between the rigid portions being flexible. In even further embodiments, one or more of the tubes in the plurality of passage tubes 020 are rigid, while the rest of the tubes are flexible. For example, half of the middle group of six passage tubes 022 are rigid with the remaining passage tubes having flexible or alternative (e.g., swirly, helical, round-about, etc.) designs.

Figure 8:
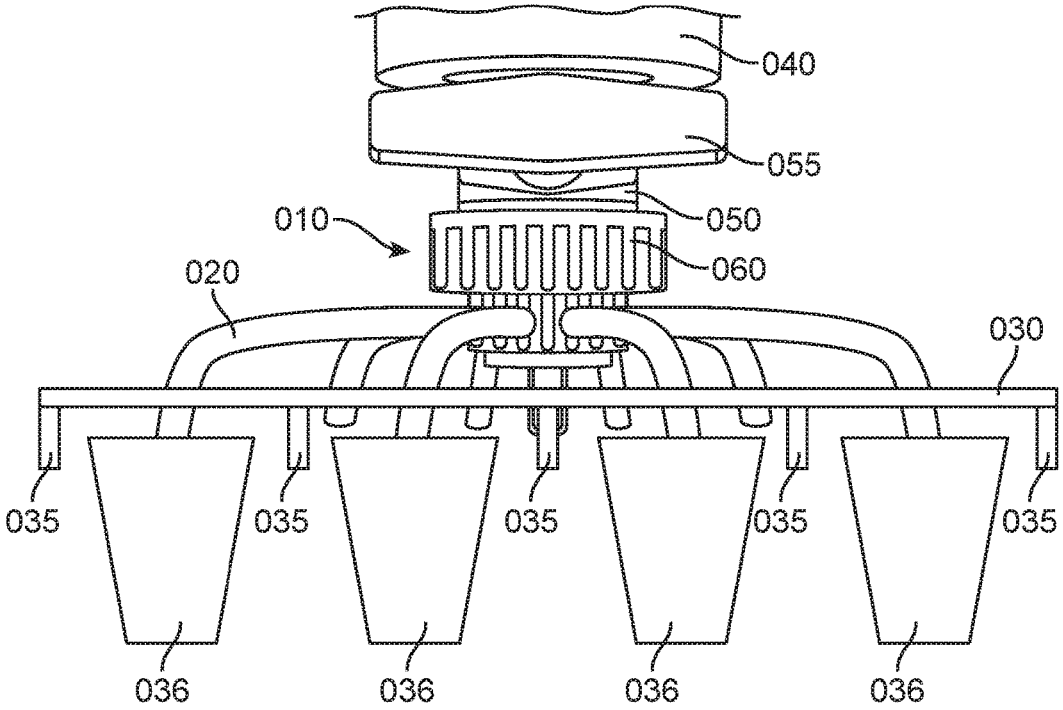
FIG. 8 is a side view of a plurality of cups and a beverage distributor for party games with vertical extensions, according to another example embodiment.

FIG. 8 is a side view of the base 030 with vertical extensions 035 and the plurality of cups 036. In some embodiments, there may be vertical extensions 035 that protrude from the base 030 away from the reservoir 040. These vertical extensions 035 may allow the beverage distributor for party games 100 to be elevated when placed on a horizontal surface to ensure that the plurality of outlets of the plurality of passage tubes 020 do not touch the horizontal surface in order to encourage sanitary conditions.

Further, these vertical extensions 035 may serve to arrange a plurality of cups 036 into the proper alignment for playing party games.

In some embodiments, these vertical extensions 035 may be slightly angled away from the central axis of the base 030. In those embodiments, the ends of the vertical extensions 035 that are not connected to the base 030 form a larger perimeter than that formed by the base 030. Therefore, when the beverage distributor for party games 100 is aligned on top of the plurality of cups 036, the larger perimeter formed by the vertical extensions 035 will ensure that the entire plurality of cups 036 is corralled. As the beverage distributor for party games 100 is lowered, the angle of the vertical extensions 035 will force the plurality of cups 036 into a tighter alignment.

Figure 9:
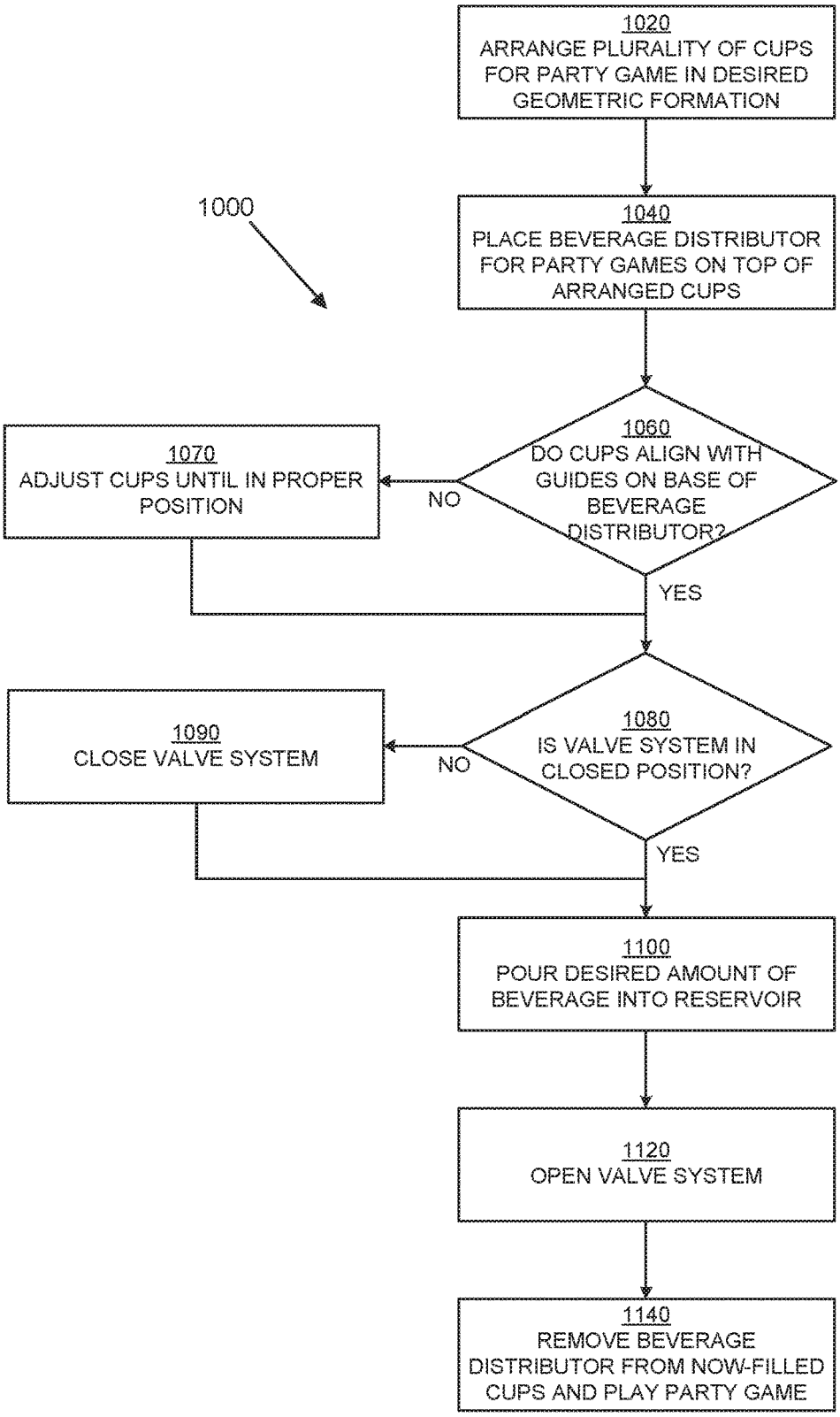
FIG. 9 is a flow diagram of a method of quickly and accurately setting up party games, according to an example embodiment.

FIG. 9 is a flow diagram illustrating a method 1000 of expediting the setup of party games and ensuring that the rules of the games are followed. In some embodiments, method 1000 is implemented by beverage distributor for party games 100 of FIG. 1.

At 1020, the plurality of cups 036 is arranged in the desired geometric formation for a particular party game. According to various embodiments, this geometric formation is a triangle composed of ten cups.

At 1040, the beverage distributor for party games 100 is placed on top of the plurality of cups.

At 1060, a user checks the alignment of the cups 036 with the beverage distributor for party games 100. In some embodiments, this process might consist of ensuring that the fixed portions of the plurality of outlets of the plurality of passage tubes 020 line up with the cups 036. In some embodiments, this process might consist of using vertical extensions 035 that protrude from the base 030 to line up the cups 036. In some embodiments, this process might consist of ensuring that the outer edges of the formation of the cups 036 line up with the outline of the base 030.

At 1070, the cups 036 are adjusted until proper alignment is achieved.

At 1080, the user checks that the valve 010 is in the closed position. In some embodiments, the valve 010 only has an open position and a closed position. In other embodiments, there are various positions within the extremes of fully open and fully closed. When the valve 010 is in the closed position, any fluid poured into a reservoir 040 of the beverage distributor for party games 100 is prevented from flowing through the rest of the device.

At 1090, the valve 010 is placed into the closed position.

At 1100, a beverage is poured into the reservoir 040 until the desired amount of beverage is reached. According to various embodiments, the amount of beverage is checked against measurements marked on the reservoir 040. In some embodiments, these measurements are written on the side of the reservoir 040. In some embodiments, these measurements are etched or molded into the reservoir 040.

At 1120, the valve 010 is placed into the open position. In the open position, any beverage contained within the reservoir 040 is allowed to flow through the rest of the beverage distributor 100. According to various embodiments, the beverage may then flow through into a passage tube junction 060, into a plurality of passage tubes 020, and into the plurality of cups 036.

At 1140, the beverage distributor for party games 100 is removed; the plurality of cups 036 are now filled, and the party game is able to be played.

The above method 1000 is merely exemplary, as alternative arrangements of the various steps are possible. For example, an alternative method could include arranging the plurality of cups 036 (e.g., 1020), ensuring the valve 010 is in the closed position (e.g., 1080), pouring the beverage into the reservoir 040 (e.g., 1100), aligning the cups 036 (e.g., 1060), and opening the valve 010 (e.g., 1120).

It is important to note that the construction and arrangement of the various example embodiments are illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. For example, elements shown as integrally formed may be constructed of multiple parts or elements, the position of elements may be reversed or otherwise varied, and the nature or number of discrete elements or positions may be altered or varied. The order or sequence of any process or method steps may be varied or re- sequenced according to alternative embodiments. Additionally, features from particular embodiments may be combined with features from other embodiments as would be understood by one of ordinary skill in the art. Other substitutions, modifications, changes and omissions may also be made in the design, operating conditions and arrangement of the various example embodiments without departing from the scope of the present invention.

It should be noted that any use of the term "example" herein to describe various embodiments is intended to indicate that such embodiments are possible examples, representations, and/or illustrations of possible embodiments (and such term is not intended to connote that such embodiments are necessarily extraordinary or superlative examples).

As utilized herein, the term "substantially" and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed (e.g., within plus or minus five percent of a given angle or other value) are considered to be within the scope of the invention as recited in the appended claims. The term "approximately" when used with respect to values means plus or minus five percent of the associated value.

The terms "coupled" and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the FIGURES. It should be noted that the orientation of various elements may differ according to other example embodiments, and that such variations are intended to be encompassed by the present disclosure.

What is claimed is:

1. A device comprising:

a reservoir, the reservoir having a reservoir first end and a reservoir second end, wherein the reservoir first end and reservoir second end are open;

a valve connected to the reservoir second end, the valve controlling a flow of fluid from the reservoir;

a base disposed below the reservoir, the base comprising a center point and a perimeter, the center point substantially central to the perimeter; and a plurality of passage tubes connected to the valve, each of the plurality of passage tubes having an inlet and an outlet, wherein each inlet of the plurality of passage tubes is in fluid communication with the valve to receive the flow of fluid, and the plurality of passage tubes comprising:

a first passage tube comprising a first diameter and a first length, wherein the first diameter is structured to cause a first flow rate of the flow of fluid through the first passage tube, wherein the first passage tube is positioned substantially near the center point;

a second passage tube comprising a second diameter and a second length, the second passage tube extending from the valve in a second direction toward the perimeter of the base, wherein the second diameter is structured to cause a second flow rate of the flow of fluid through the second passage tube, the first length is less than the second length;

a third passage tube comprising a third diameter substantially similar to the second diameter and a third length substantially similar to the second length, the third passage tube extending from the valve in a third direction toward the perimeter of the base;

a fourth passage tube comprising a fourth diameter substantially similar to the second diameter and a fourth length substantially similar to the second length, the fourth passage tube extending from the valve in a fourth direction toward the perimeter of the base;

a fifth passage tube comprising a fifth diameter substantially similar to the second diameter and a fifth length substantially similar to the second length, the fifth passage tube extending from the valve in a fifth direction toward the perimeter of the base, the fifth direction extending opposite of the second direction;

a sixth passage tube comprising a sixth diameter substantially similar to the second diameter and a sixth length substantially similar to the second length, the sixth passage tube extending from the valve in a sixth direction toward the perimeter of the base, the sixth direction extending opposite of the third direction;

a seventh passage tube comprising a seventh diameter substantially similar to the second diameter and a seventh length substantially similar to the second length the seventh passage tube extending from the valve in a seventh direction toward the perimeter of the base, the seventh direction extending opposite of the fourth direction;

wherein the outlet of the second passage tube, the third passage tube, the fourth passage tube, the fifth passage tube, the sixth passage tube, and the seventh passage tube form a first circular arrangement substantially concentric to the first passage tube with a first circular center point is substantially similar to the center point of the base, an eighth passage tube comprising an eighth diameter and an eighth length, the eighth passage tube extending from the valve in an eighth direction toward the perimeter of the base, the eighth passage tube extending between the third passage tube and the fourth passage tube, wherein the eighth diameter is structured to cause a third flow rate of the flow of fluid through the eighth passage tube, wherein the eighth length is longer than the first length and the second length;

a ninth passage tube comprising a ninth diameter substantially similar to the eighth diameter and a ninth length substantially similar to the eighth length, the ninth passage tube extending from the valve in a ninth direction toward the perimeter of the base, the ninth passage tube extending between the fifth passage tube and the sixth passage tube; and a tenth passage tube comprising a tenth diameter substantially similar to the eighth diameter and a tenth length substantially similar to the eighth length, the tenth passage tube extending from the valve in a tenth direction toward the perimeter of the base, the tenth passage tube extending between the seventh passage tube and the second passage tube, wherein the base connected to at least one of the first passage tube, the second passage tube, and the eighth passage tube, wherein the at least one of the first passage tube, the second passage tube, and the eighth passage tube pass through the base.

2. The device of claim 1, wherein the valve comprises a flow restrictor, the flow restrictor comprising an open position and a closed position, the open position allowing the flow of fluid therethrough, the closed position preventing the flow of fluid therethrough.

3. The device of claim 1, wherein the plurality of passage tubes are rigid, and wherein the rigidity of the plurality of passage tubes provides support for the valve.

4. The device of claim 1, wherein the first passage tube is a rigid tube and the second passage tube is flexible, wherein the rigidity of the first passage tube provides support for the valve.

5. The device of claim 1, wherein the first passage tube has a first tube portion adjacent the inlet and a second tube portion adjacent the first tube portion, the first tube portion being a rigid portion and the second tube portion being a flexible portion.

6. The device of claim 1, wherein the first passage tube has a first tube portion adjacent the inlet and a second tube portion adjacent the first tube portion, the first tube portion being a flexible portion and the second tube portion being a rigid portion.

7. The device of claim 1, wherein the valve comprises a first valve and a second valve, wherein the first valve is disposed along a flow path of the first passage tube, and wherein the second valve is disposed along a flow path of the second passage tube, the first valve throttling the flow of fluid through at least the first passage tube, the second valve throttling the flow of fluid through at least the second passage tube.

8. The device of claim 1, wherein the first diameter, second diameter, and third diameter are substantially similar and wherein each inlet of the plurality of passage tubes connect to the valve at a substantially similar height relative to the base.

9. The device of claim 1, wherein the first diameter, second diameter, and third diameter are different and wherein the first length, second length, and third length are different such that the flow of fluid through the first passage tube, second passage tube, and third passage tube are substantially similar.

10. The device of claim 1, wherein the valve comprises:

a flow restrictor, wherein the flow restrictor has a manually alterable aperture to throttle the flow of fluid through the valve; and a passage tube junction downstream the flow restrictor, wherein a first inlet of the first passage tube is disposed radially outward from the passage tube junction, a second inlet of the second passage tube is disposed radially outward from a side of the passage tube junction, and a third inlet of the third passage tube is disposed axially away from a bottom of the passage tube junction.

11. The device of claim 1, wherein the base comprises a plurality of vertical extensions, the plurality of vertical extensions extending axially away from the valve and structured to align a plurality of cups placed underneath the base.

12. The device of claim 1, wherein each outlet of the plurality of passage tubes extends downward away from the base.

13. The device of claim 1, wherein the reservoir is removably coupled to the valve.

14. The device of claim 1, wherein the valve is removably coupled to the base.

15. A method comprising:

placing a plurality of cups in a desired formation;

orienting a beverage distributor for party games above the plurality of cups, the beverage distributor comprising:

a reservoir, the reservoir having a reservoir first end and a reservoir second end, wherein the reservoir first end and reservoir second end are open;

a valve connected to the reservoir second end, the valve throttling a flow of fluid from the reservoir;

a base disposed below the reservoir, the base comprising a center point and a perimeter, the center point substantially central to the perimeter; and a plurality of passage tubes connected to the valve, each of the plurality of passage tubes having an inlet and an outlet, wherein each inlet of the plurality of passage tubes is in fluid communication with the valve to receive the flow of fluid, and the plurality of passage tubes comprising:

a first passage tube comprising a first diameter and a first length, wherein the first diameter is structured to cause a first flow rate of the flow of fluid through the first passage tube, wherein the first passage tube is positioned substantially near the center point;

a second passage tube comprising a second diameter and a second length, the second passage tube extending from the valve in a second direction toward the perimeter of the base, wherein the second diameter is structured to cause a second flow rate of the flow of fluid through the second passage tube, the first length is less than the second length;

a third passage tube comprising a third diameter substantially similar to the second diameter and a third length substantially similar to the second length, the third passage tube extending from the valve in a third direction toward the perimeter of the base;

a fourth passage tube comprising a fourth diameter substantially similar to the second diameter and a fourth length substantially similar to the second length, the fourth passage tube extending from the valve in a fourth direction toward the perimeter of the base;

a fifth passage tube comprising a fifth diameter substantially similar to the second diameter and a fifth length substantially similar to the second length, the fifth passage tube extending from the valve in a fifth direction toward the perimeter of the base, the fifth direction extending opposite of the second direction;

a sixth passage tube comprising a sixth diameter substantially similar to the second diameter and a sixth length substantially similar to the second length, the sixth passage tube extending from the valve in a sixth direction toward the perimeter of the base, the sixth direction extending opposite of the third direction;

a seventh passage tube comprising a seventh diameter substantially similar to the second diameter and a seventh length substantially similar to the second length, the seventh passage tube extending from the valve in a seventh direction toward the perimeter of the base, the seventh direction extending opposite of the fourth direction;

wherein the outlet of the second passage tube, the third passage tube, the fourth passage tube, the fifth passage tube, the sixth passage tube, and the seventh passage tube form a first circular arrangement substantially concentric to the first passage tube with a first circular center point is substantially similar to the center point of the base, an eighth passage tube comprising an eighth diameter and an eighth length, the eighth passage tube extending from the valve in an eighth direction toward the perimeter of the base, the eighth passage tube extending between the third passage tube and the fourth passage tube, wherein the eighth diameter is structured to cause a third flow rate of the flow of fluid through the eighth passage tube, wherein the eighth length is longer than the first length and the second length;

a ninth passage tube comprising a ninth diameter substantially similar to the eighth diameter and a ninth length substantially similar to the eighth length, the ninth passage tube extending from the valve in a ninth direction toward the perimeter of the base, the ninth passage tube extending between the fifth passage tube and the sixth passage tube; and a tenth passage tube comprising a tenth diameter substantially similar to the eighth diameter and a tenth length substantially similar to the eighth length, the tenth passage tube extending from the valve in a tenth direction toward the perimeter of the base, the tenth passage tube extending between the seventh passage tube and the second passage tube, wherein the base connected to at least one of the first passage tube, the second passage tube, and the eighth passage tube, wherein the at least one of the first passage tube, the second passage tube, and the eighth passage tube pass through the base;

aligning the base of the beverage distributor with the desired for ion of the plurality of cups;

closing the valve attached to the base of the beverage distributor;

pouring a fluid into the reservoir of the beverage distributor; and opening the valve, causing the fluid to travel through the plurality of passage tubes and into the plurality of cups.

16. The device of claim 1, wherein the valve is a first valve, further comprising a second valve disposed along the sixth passage tube, a third valve disposed along the seventh passage tube, a fourth valve disposed along the ninth passage tube, and a fifth vale disposed along the tenth passage tube.

17. The device of claim 16, wherein opening the second valve simultaneously opens the third valve, the fourth valve, and the fifth valve.

* * * * *